US007200991B2

(12) United States Patent
Otake et al.

(10) Patent No.: US 7,200,991 B2
(45) Date of Patent: Apr. 10, 2007

(54) REGENERATION CONTROL OF DIESEL PARTICULATE FILTER

(75) Inventors: Makoto Otake, Yokohama (JP); Junichi Kawashima, Yokosuka (JP); Naoya Tsutsumoto, Yokohama (JP); Terunori Kondou, Yokohama (JP); Takao Inoue, Yokohama (JP); Shouichirou Ueno, Yokohama (JP); Toshimasa Koga, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 106 days.

(21) Appl. No.: 10/934,390

(22) Filed: Sep. 7, 2004

(65) Prior Publication Data

US 2005/0056005 A1 Mar. 17, 2005

(30) Foreign Application Priority Data

Sep. 17, 2003 (JP) ..... 2003-325028

(51) Int. Cl.
*F01N 3/02* (2006.01)
*F01N 3/00* (2006.01)

(52) U.S. Cl. ..... 60/311; 60/295; 60/297

(58) Field of Classification Search ..... 60/295, 60/297, 311
See application file for complete search history.

(56) References Cited

U.S. PATENT DOCUMENTS 4,424,671 A * 1/1984 Tokura ..... 60/274
5,319,930 A * 6/1994 Shinzawa et al. ..... 60/286
5,444,442 A * 8/1995 Sadakata et al. ..... 340/916
5,826,425 A * 10/1998 Rossi Sebastiano et al. .. 60/274
5,924,406 A * 7/1999 Kinugasa et al. ..... 123/436
6,032,461 A * 3/2000 Kinugasa et al. ..... 60/295
6,092,014 A * 7/2000 Okada ..... 701/70
6,497,095 B2 * 12/2002 Carberry et al. ..... 60/295
6,851,258 B2 * 2/2005 Kawashima et al. ..... 60/311
2003/0230078 A1 * 12/2003 Yahata et al. ..... 60/295
2004/0055279 A1 * 3/2004 Plote et al. ..... 60/274

FOREIGN PATENT DOCUMENTS

DE 199 48 236 A1 4/2001
DE 100 56 034 A1 5/2002
EP 1 195 508 A2 4/2002
EP 1 203 876 A1 5/2002
EP 1 203 877 A1 5/2002
WO WO 97/16632 5/1997

* cited by examiner

*Primary Examiner*—Thomas Denion
*Assistant Examiner*—Loren Edwards
(74) *Attorney, Agent, or Firm*—Foley & Lardner LLP

(57) ABSTRACT

A filter (10) which traps particulate matter contained in the exhaust gas of a diesel engine (20) for a vehicle is regenerated by fuel injection control. A controller (16) calculates a representative value of the operating condition of the diesel engine (20) during a latest predetermined time period, and determines the traveling condition of the vehicle on the basis of this representative value. When the representative value corresponds to a highway traveling condition, fuel injection control is performed in accordance with a pattern for burning all of the particulate matter trapped in the filter (10). Under any other conditions, fuel injection control is performed in accordance with another pattern. Hence optimum filter regeneration can be performed depending on the traveling condition of the vehicle.

9 Claims, 6 Drawing Sheets

REGENERATION CONTROL OF DIESEL PARTICULATE FILTER

FIELD OF THE INVENTION

This invention relates to regeneration control of a filter which traps particulate matter contained in the exhaust gas of a diesel engine.

BACKGROUND OF THE INVENTION

A diesel particulate filter (hereinafter referred to as DPF) which traps particulate matter contained in the exhaust gas of a diesel engine for a vehicle performs regeneration by burning the trapped particulate matter when the amount of trapped particulate matter reaches a certain level, and thus becomes able to trap particulate matter again. The amount of trapped particulate matter is determined by estimate from the operating condition of the vehicle. DPF regeneration is performed by raising the exhaust gas temperature of the engine to burn the particulate matter.

SUMMARY OF THE INVENTION

The operating condition of the vehicle varies constantly, and hence it is difficult to burn all of the particulate matter trapped in the DPF in one regeneration operation. As a result, particulate matter trapping may resume with the particulate matter inside the DPF in an unevenly distributed state. Such a state causes the estimation precision of the trapped particulate matter amount to deteriorate, and may lead to irregular combustion of the trapped particulate matter, which is undesirable.

WO97-16632 proposes that the vehicle operating condition and the exhaust gas transition be predicted on the basis of information from a car navigation system so that the DPF is regenerated only when it is determined that appropriate conditions for regeneration have been satisfied.

According to this system, as long as the predictions are correct, DPF regeneration is executed under appropriate conditions, and the particulate matter is removed completely.

However, a car navigation system is too costly if it is used only for the purpose of DPF regeneration.

It is therefore an object of this invention is to perform DPF regeneration in accordance with a traveling condition, without the use of a car navigation system.

In order to achieve the above object, this invention provides a regeneration device for a filter which traps particulate matter contained in an exhaust gas of a diesel engine for a vehicle. The device comprises a parameter detecting sensor which detects a parameter relating to an amount of particulate matter trapped in the filter, a removal mechanism which removes the particulate matter trapped by the filter, an engine operating condition detecting sensor which detects an operating condition of the diesel engine, and a programmable controller which controls the removal mechanism. The controller is programmed to determine whether or not the amount of particulate matter trapped in the filter has reached a predetermined amount, calculate from the operating condition of the diesel engine a representative value of the operating condition of the diesel engine during a latest predetermined time period, determine a traveling condition of the vehicle based on the representative value, and control the removal mechanism, when the amount of trapped particulate matter has reached the predetermined amount, to remove the particulate matter by applying a different pattern according to the traveling condition of the vehicle.

This invention also provides a regeneration method for a filter which traps particulate matter contained in an exhaust gas of a diesel engine for a vehicle. The vehicle comprises a removal mechanism for removing the particulate matter trapped by the filter. The method comprises determining a parameter relating to an amount of particulate matter trapped in the filter, determining an operating condition of the diesel engine, determining whether or not the amount of particulate matter trapped in the filter has reached a predetermined amount, calculating from the operating condition of the diesel engine a representative value of the operating condition of the diesel engine during a latest predetermined time period, determining a traveling condition of the vehicle based on the representative value, and controlling the removal mechanism, when the amount of trapped particulate matter has reached the predetermined amount, to remove the particulate matter by applying a different pattern according to the traveling condition of the vehicle.

The details as well as other features and advantages of this invention are set forth in the remainder of the specification and are shown in the accompanying drawings.

DESCRIPTION OF THE PREFERRED EMBODIMENTS

Figure 1:
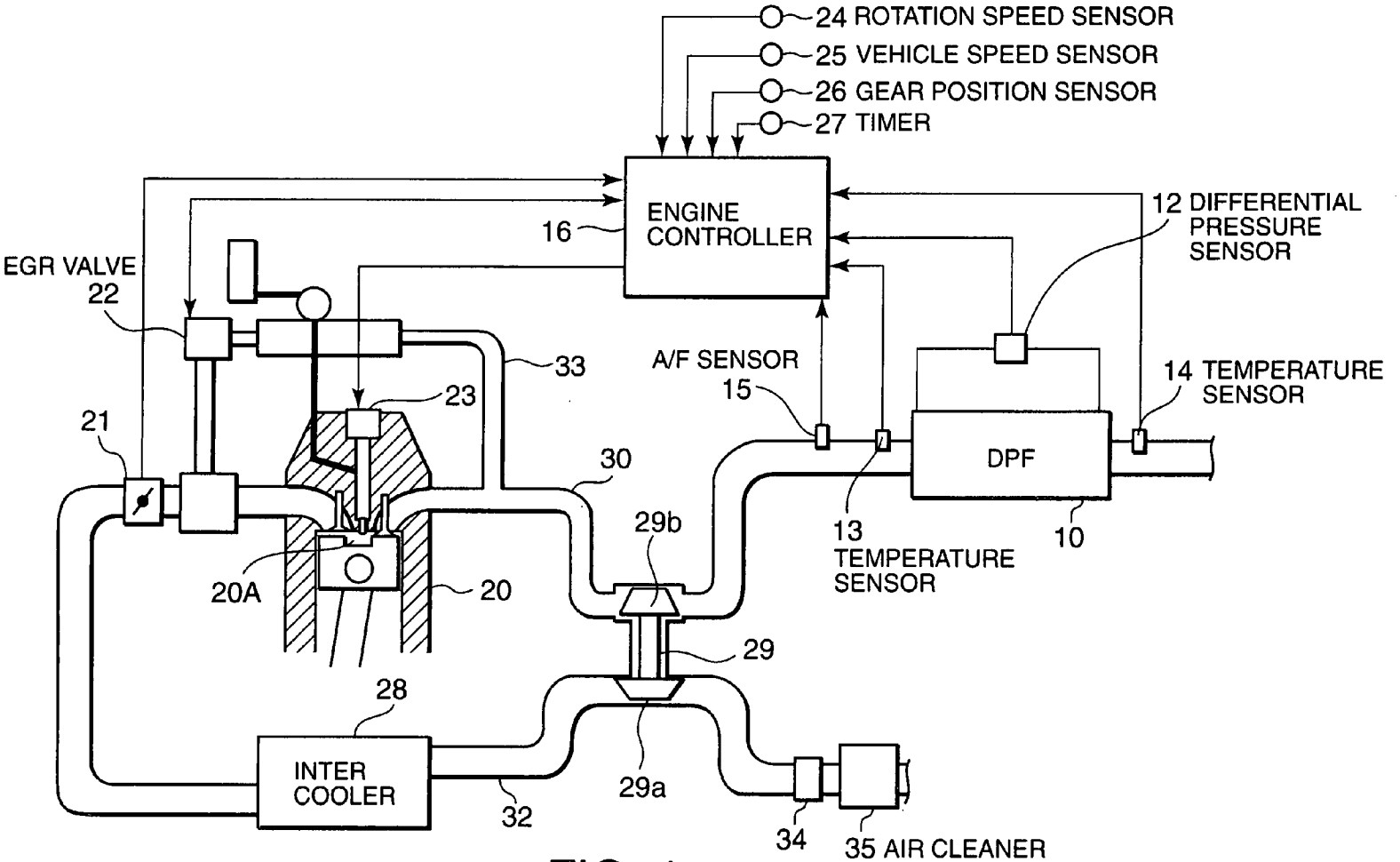
FIG. 1 is a schematic diagram of an engine for use in a vehicle, comprising a DPF regeneration device according to this invention.

Referring to FIG. 1 of the drawings, a diesel engine 20 for use in a vehicle comprises an intake passage 32 and an exhaust passage 30 connected to a combustion chamber 20A.

The diesel engine 20 burns a mixture of air that is aspirated into the combustion chamber 20A from the intake passage 32 and fuel that is injected into the combustion chamber 20A by a fuel injector 23 by means of compression ignition. The combustion gas is discharged from the exhaust passage 30 as exhaust gas.

An air cleaner 35, a compressor 29A of a turbocharger 29, an inter cooler 28, and an intake throttle 21 are provided on the intake passage 32. The intake air in the intake passage 32 is purified by the air cleaner 35, compressed by the compressor 29A, cooled by the inter cooler 28, and then aspirated into the combustion chamber 20A via the intake throttle 21.

A turbine 29B of the turbocharger 29 and a DPF 10 are provided on the exhaust passage 30. The exhaust gas that is discharged from the combustion chamber 20A into the exhaust passage 30 drives the turbine 29B to rotate. The exhaust gas is then discharged into the atmosphere after trapping particulate matter in the DPF 10.

A part of the exhaust gas in the exhaust passage 30 is recirculated into the intake air via an exhaust gas recirculation passage (EGR passage) 33. The EGR passage 33 connects the exhaust passage 30 upstream of the turbine 29B to the intake passage 32 downstream of the intake throttle 21. An exhaust gas recirculation valve (EGR valve) 22 for regulating the exhaust gas recirculation flow (EGR flow) is provided in the EGR passage 33.

The DPF 10 traps particulate matter contained in the exhaust gas in the exhaust passage 30, and regenerates by burning the trapped particulate matter at a predetermined regeneration temperature. A known ceramic porous filter may be used as the DPF 10.

Regeneration of the DPF 10 is performed by raising the exhaust gas temperature through control of the fuel injection amount and injection timing of the fuel injector 23 using an engine controller 16. Control of the injection timing to raise the exhaust gas temperature includes post-injection and injection timing retardation. Such fuel injection control for raising the exhaust gas temperature is well-known.

The engine controller 16 is constituted by a microcomputer comprising a central processing unit (CPU), read-only memory (ROM), random access memory (RAM), and an input/output interface (I/O interface). The controller may be constituted by a plurality of microcomputers.

To control regeneration of the DPF 10, detection data from an air flow meter 34 which detects the intake air amount, a differential pressure sensor 12 which detects the differential pressure between the inlet and outlet of the DPF 10, a temperature sensor 13 which detects the exhaust gas temperature upstream of the DPF 10, a temperature sensor 14 which detects the exhaust gas temperature downstream of the DPF 10, an air/fuel ratio sensor (A/F sensor) 15 which detects the air/fuel ratio of the air/fuel mixture supplied to the combustion chamber 20A from the oxygen concentration in the exhaust gas, a rotation speed sensor 24 which detects the rotation speed of the diesel engine 20, a vehicle speed sensor 25 which detects the traveling speed of the vehicle, a gear position sensor 26 which detects the gear position of a transmission in the vehicle, and a timer 27 are input respectively into the controller 16 as signals. A universal exhaust gas oxygen sensor or a less expensive oxygen sensor may be used as the A/F sensor 15.

The engine controller 16 estimates the combustion condition of the particulate matter inside the DPF 10 on the basis of these signals.

Meanwhile, the traveling condition of the vehicle is determined on the basis of the rotation speed of the diesel engine 20, the vehicle speed, the gear position of the transmission, and the measured time on the timer 27.

The traveling condition of the vehicle and regeneration of the DPF 10 will now be described.

Figure 3:
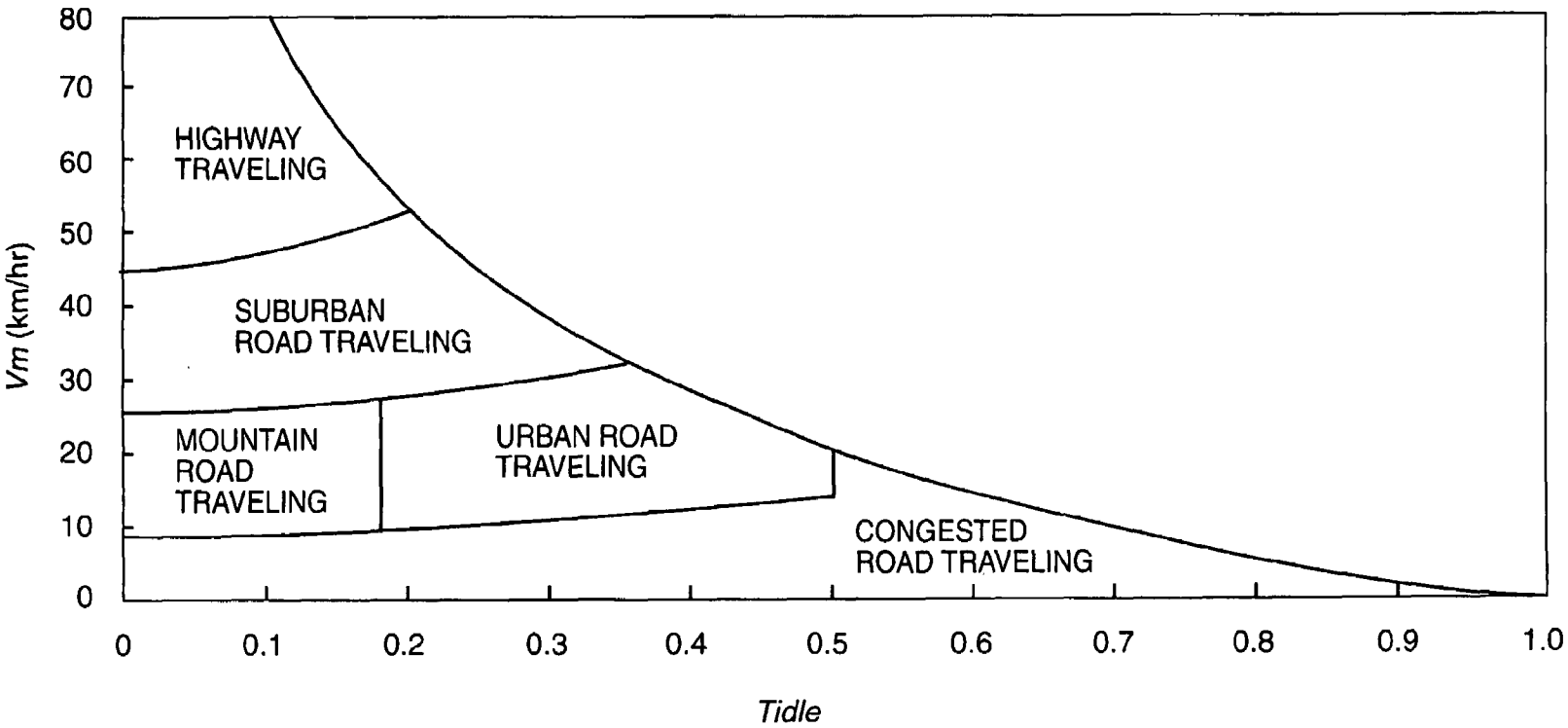
FIG. 3 is a diagram illustrating the characteristic of a map for determining a traveling condition, which is stored by the controller.

Referring to FIG. 3, in this embodiment, the traveling condition of the vehicle is divided into five conditions, namely highway traveling, suburban road traveling, mountain road traveling, urban road traveling, and congested road traveling, using as parameters an average vehicle speed Vm and a proportion of time Tidle in which the diesel engine 20 is running idle during a predetermined time period up to the present time. The predetermined time period is set at five minutes.

As shown in the diagram, during congested road traveling, the idling time proportion Tidle is high and the average vehicle speed Vm is low compared to the other four traveling conditions. During highway traveling, the average speed Vm is high and the idling time proportion Tidle is low compared to the other four conditions.

In the suburban road traveling condition, the idling time proportion Tidle is substantially equal to that of the highway traveling condition, but the average vehicle speed Vm is lower than that of the highway traveling condition.

In the mountain road traveling condition, the idling time proportion Tidle is low and the average vehicle speed Vm is low. In the urban traveling condition, the average vehicle speed Vm is substantially equal to that of the mountain road traveling condition, but the idling time proportion Tidle is higher than that of the mountain road traveling condition. The average vehicle speeds Vm of the mountain road traveling condition and urban road traveling condition are both located in a lower speed region than the average vehicle speed Vm of the suburban road traveling condition.

In the highway traveling condition, the exhaust gas temperature of the diesel engine 20 is high, and the particulate matter can be burned sufficiently without performing a special operation to raise the temperature of the DPF 10. Hence the amounts of post-injection and injection timing retardation used to raise the temperature are small, and the fuel consumption amount required to regenerate the DPF 10 can be held at a minimum. In this environment, it is also possible to burn all of the particulate matter trapped in the DPF 10 such that the DPF is completely regenerated.

In the suburban road traveling condition, the average vehicle speed Vm is lower than that of the highway traveling condition, and hence the temperature of the DPF 10 is lower than the temperature in the highway traveling condition. Accordingly, the extent by which the temperature must be raised to regenerate the DPF 10 is greater than in the highway traveling condition. Hence in comparison with the highway traveling condition, greater amounts of post-injection and injection timing retardation are needed to raise the temperature, and a greater amount of fuel is consumed in the temperature raising operation.

In the mountain road traveling condition and urban road traveling condition, the average vehicle speed is even lower than that of the suburban road traveling condition, and hence the temperature of the DPF 10 is also lower than that of the suburban road traveling condition. Therefore, in both of these traveling conditions the amounts of post-injection and injection timing retardation increase beyond those in the suburban road regeneration pattern.

However, the idling frequency of the mountain road traveling condition is lower than that of the urban road traveling condition, and hence it is easier to maintain the exhaust gas temperature that is raised during traveling, and easier to raise the exhaust gas temperature due to the large load that is applied as the vehicle climbs. As a result, the post-injection amount and injection timing retardation amount required to raise the temperature of the DPF 10 to its regeneration temperature are smaller in the mountain road regeneration pattern than in the urban road regeneration pattern.

In the congested road traveling condition, the average vehicle speed is low and the idling frequency is high, and hence the exhaust gas temperature is low. Accordingly, the temperature of the DPF 10 is also low, and large amounts of post-injection and injection timing retardation are required to raise the temperature of the DPF 10 to its regeneration temperature. As a result, a large amount of fuel is consumed to regenerate the DPF 10 in the congested road traveling condition.

As described above, the amounts of post-injection and injection timing retardation required to raise the temperature of the DPF 10 to its regeneration temperature are smallest in the highway regeneration pattern, and then increase gradually through the suburban road regeneration pattern, the mountain road regeneration pattern, the urban road regeneration pattern, and the congested road regeneration pattern. In other words, if the DPF 10 is always regenerated in the highway regeneration pattern, increases in fuel consumption can be held to a minimum. However, if the amount of particulate matter trapped in the DPF 10 reaches its limit, then the DPF 10 must be regenerated even when traveling on congested roads.

By ensuring that the DPF 10 is regenerated reliably and completely in the highway traveling condition, the frequency with which the DPF 10 needs to be regenerated under less favorable traveling conditions such as congested roads can be reduced, and hence increases in the amount of fuel consumption required to regenerate the DPF 10 can be prevented.

Completely regenerating the DPF 10 also improves the estimation precision of the amount of particulate matter trapped in the DPF 10, which is estimated from the differential pressure between the inlet and outlet of the DPF 10. By improving the estimation precision of the amount of trapped particulate matter, unnecessary regeneration operations of the DPF 10 can be prevented, and increases in the number of times the DPF 10 is regenerated can be suppressed. If the DPF 10 is regenerated when the amount of trapped particulate matter exceeds the estimated amount, the temperature may rise excessively, but improving the estimation precision can prevent such defects.

Figure 2:
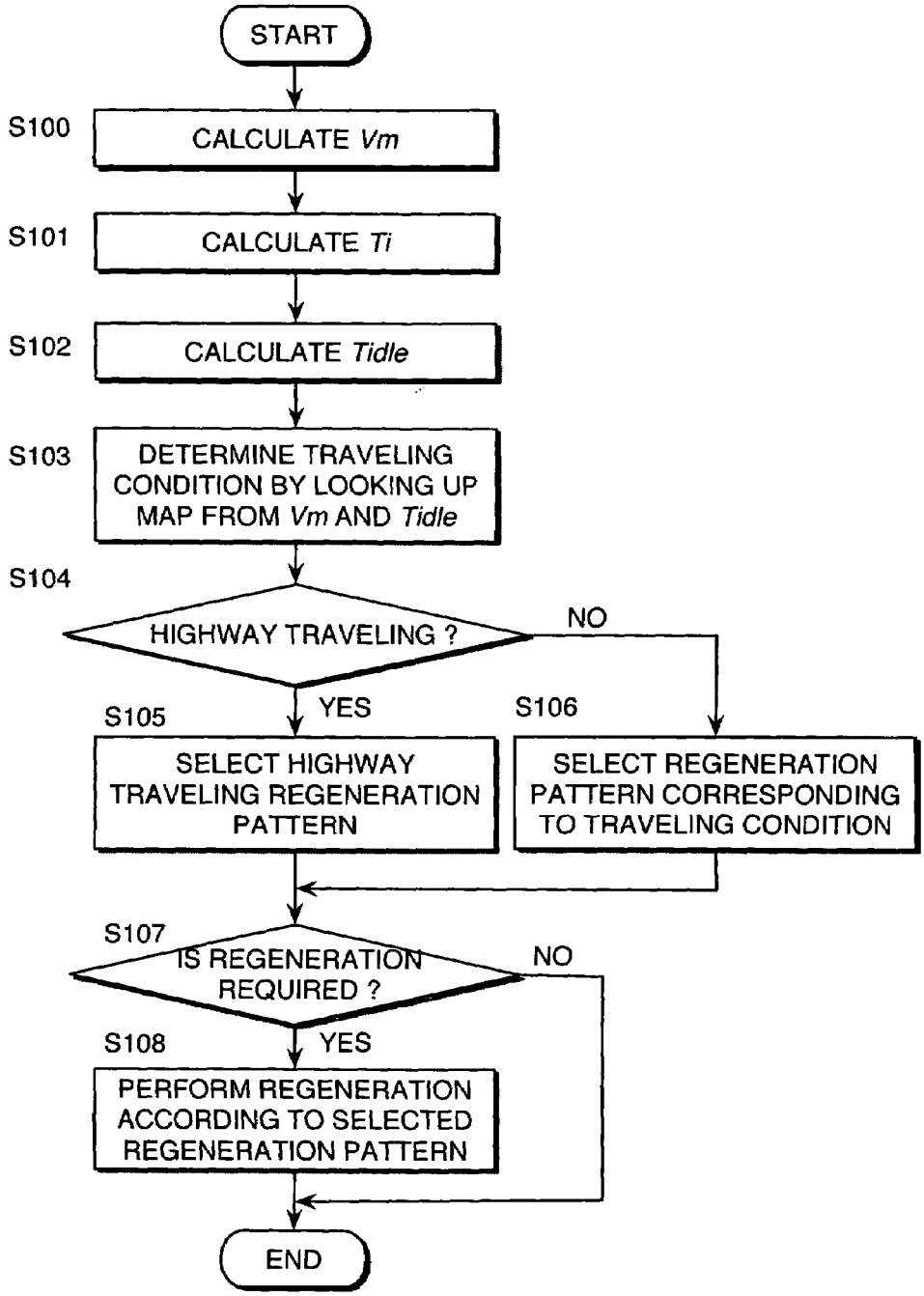
FIG. 2 is a flowchart illustrating a DPF regeneration control routine executed by a controller according to this invention.

Next, referring to FIG. 2, a control routine for regenerating the DPF 10, which is executed by the engine controller 16 on the basis of the vehicle traveling condition described above, will be described. The engine controller 16 executes this routine at intervals of ten milliseconds while the diesel engine 20 is operative.

First, in a step S100, the engine controller 16 calculates the average vehicle speed Vm during a predetermined time period Ta directly before execution of the routine from input signals from the timer 27 and vehicle speed sensor 25. As noted above, the predetermined time period Ta is set at five minutes.

In a step S101, the engine controller 16 calculates an idling time Ti of the diesel engine 20 during the time period Ta from input signals from the timer 27 and rotation speed sensor 24.

In a step S102, the engine controller 16 calculates the idling time proportion Tidle according to the following equation (1).

$$\text{Tidle}=Ti/Ta \quad (1)$$

In a step S103, the engine controller 16 refers to a map having the characteristic shown in FIG. 3 and stored in the ROM in advance to determine the traveling condition to which the combined average vehicle speed Vm and idling time proportion Tidle correspond.

In a step S104, the engine controller 16 determines whether or not the traveling condition determined in the step S103 is the highway traveling condition. If the determination result is affirmative, the engine controller 16 selects a highway traveling regeneration pattern as the regeneration pattern for the DPF 10 in a step S105, and then performs the processing of a step S107.

In the highway traveling regeneration pattern, all of the particulate matter trapped in the DPF 10 is removed. In the other regeneration patterns, the trapped particulate matter is not always removed completely.

When it is determined in the step S104 that the traveling condition is not the highway traveling condition, the engine controller 16 selects a regeneration pattern corresponding to the traveling condition in a step S106, and then performs the processing of the step S107.

In the step S107, the engine controller 16 determines whether regeneration of the DPF 10 is necessary on the basis of the amount of particulate matter trapped in the DPF 10. An amount of trapped particulate matter permitting regeneration of the DPF 10, which is set at 80–90% of the upper limit amount, is used in this determination. When the current trapped amount exceeds the regeneration permitting amount in the step S107, it is determined that the DPF 10 needs to be regenerated. As noted above, the trapped amount is estimated from the differential pressure detected by the differential pressure sensor 12.

Having determined that regeneration is necessary in the step S107, the engine controller 16 performs a regeneration operation of the DPF 10 in a step S108, based on the regeneration pattern selected in the step S105 or S106. When it is determined that regeneration is not necessary in the step S107, the controller 16 skips the step S108 and ends the routine.

Thus the engine controller 16 determines the traveling condition on the basis of the average vehicle speed Vm and idling time proportion Tidle during a predetermined time period up to the present time, and as a result, the operating condition of the engine 20 can be reflected appropriately in the regeneration of the DPF 10 without the use of an expensive device such as a car navigation system.

Figure 4:
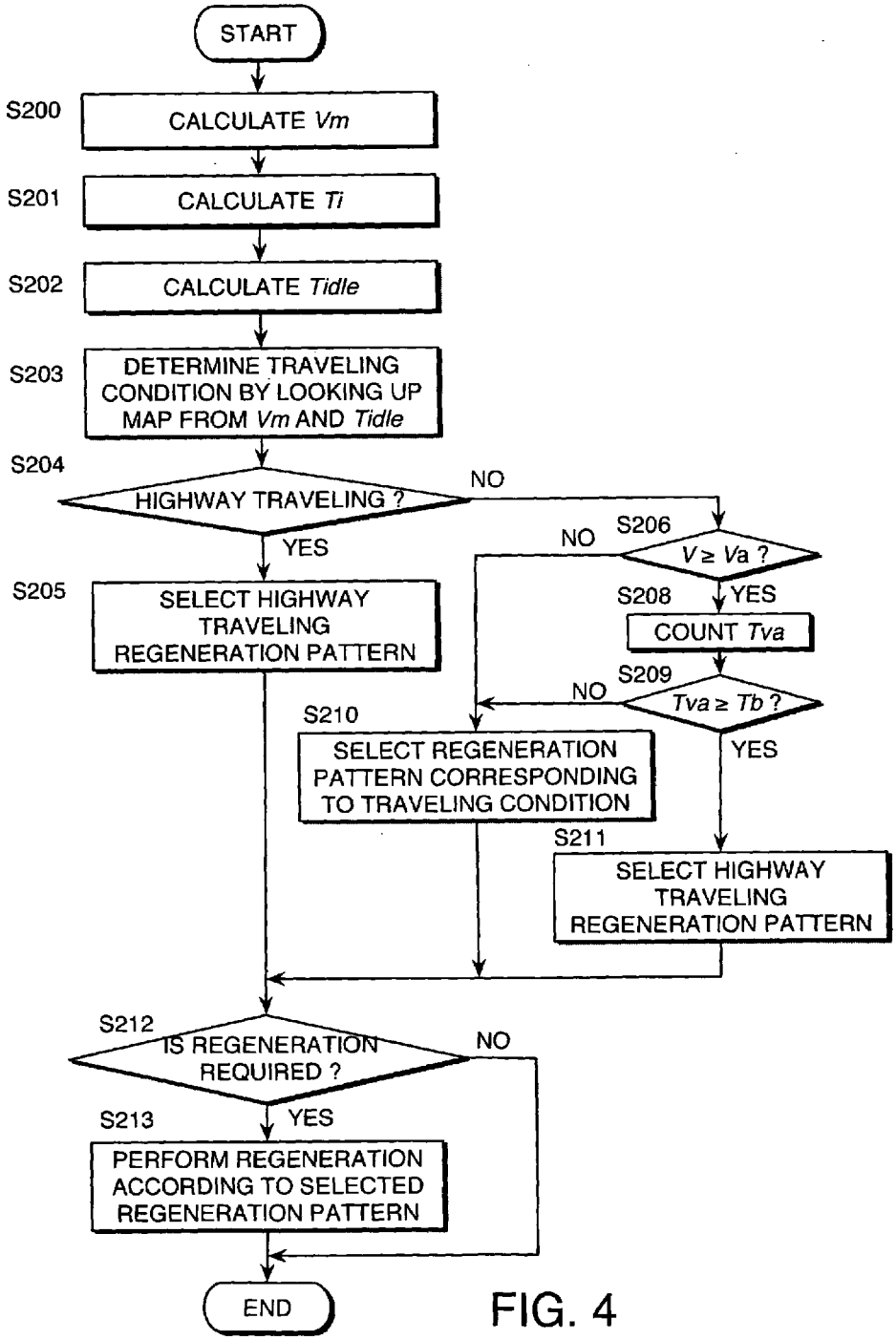
FIG. 4 is similar to FIG. 2, but shows a second embodiment of this invention.

Next, referring to FIG. 4, a second embodiment of this invention will be described.

The hardware constitution of this embodiment is identical to that of the first embodiment, but the traveling condition determination method differs from the first embodiment. In this embodiment, a routine illustrated in FIG. 4 is executed in place of the routine of the first embodiment in FIG. 2.

The processing content of steps S200–S205 is identical to that of the steps S100–S105 in the first embodiment.

When it is determined in the step S204 that the traveling condition does not correspond to the highway traveling condition, the engine controller 16 compares a current vehicle speed V to a preset target high speed Va in a step S206. The vehicle speed V is the latest speed detected by the vehicle speed sensor 25.

The target high speed Va serves as a reference for determining whether or not complete regeneration of the DPF 10 is possible. The target high speed Va is set in advance through experiment. Here, the target high speed Va is set at sixty kilometers per hour.

When the vehicle speed V is lower than the target high speed Va in the step S206, the engine controller 16 selects a regeneration pattern corresponding to the traveling condition in a step S210. The traveling condition is the traveling condition determined in the step S203.

When the vehicle speed V is equal to or higher than the target high speed Va in the step S206, the engine controller 16 measures in the step S208 a continuous time period Tva during which the vehicle speed V equals or exceeds the target high speed Va. This measurement is performed by the timer 27. Alternatively, the timer value may be counted up every time the routine is executed.

Next, in a step S209, the engine controller 16 determines whether or not the continuous time period Tva has reached a continuous high-speed traveling target time Tb. Herein, the continuous high-speed traveling target time Tb is set to two minutes. If the continuous time period Tva has not reached the continuous high-speed traveling target time Tb, the engine controller 16 selects a regeneration pattern corresponding to the traveling condition in the step S210. Following the processing of the step S210, the engine controller 16 performs the processing of a step S212.

When the continuous time period Tva has reached the continuous high-speed traveling target time Tb, the engine controller 16 selects the highway traveling regeneration pattern in a step S211. Following the processing of the step S211, the engine controller 16 performs the processing of the step S212.

The processing of the step S212 and a step S213 is identical to the processing of the steps S107 and S108 in the first embodiment.

In this embodiment, the highway traveling regeneration pattern is executed when the vehicle speed V equals or exceeds the target high speed Va continuously for the continuous high speed traveling target time Tb, even when the traveling condition during the predetermined time period up to the present time does not correspond to the highway traveling condition. As a result, opportunities for executing complete regeneration of the DPF 10 can be increased.

Figure 5:
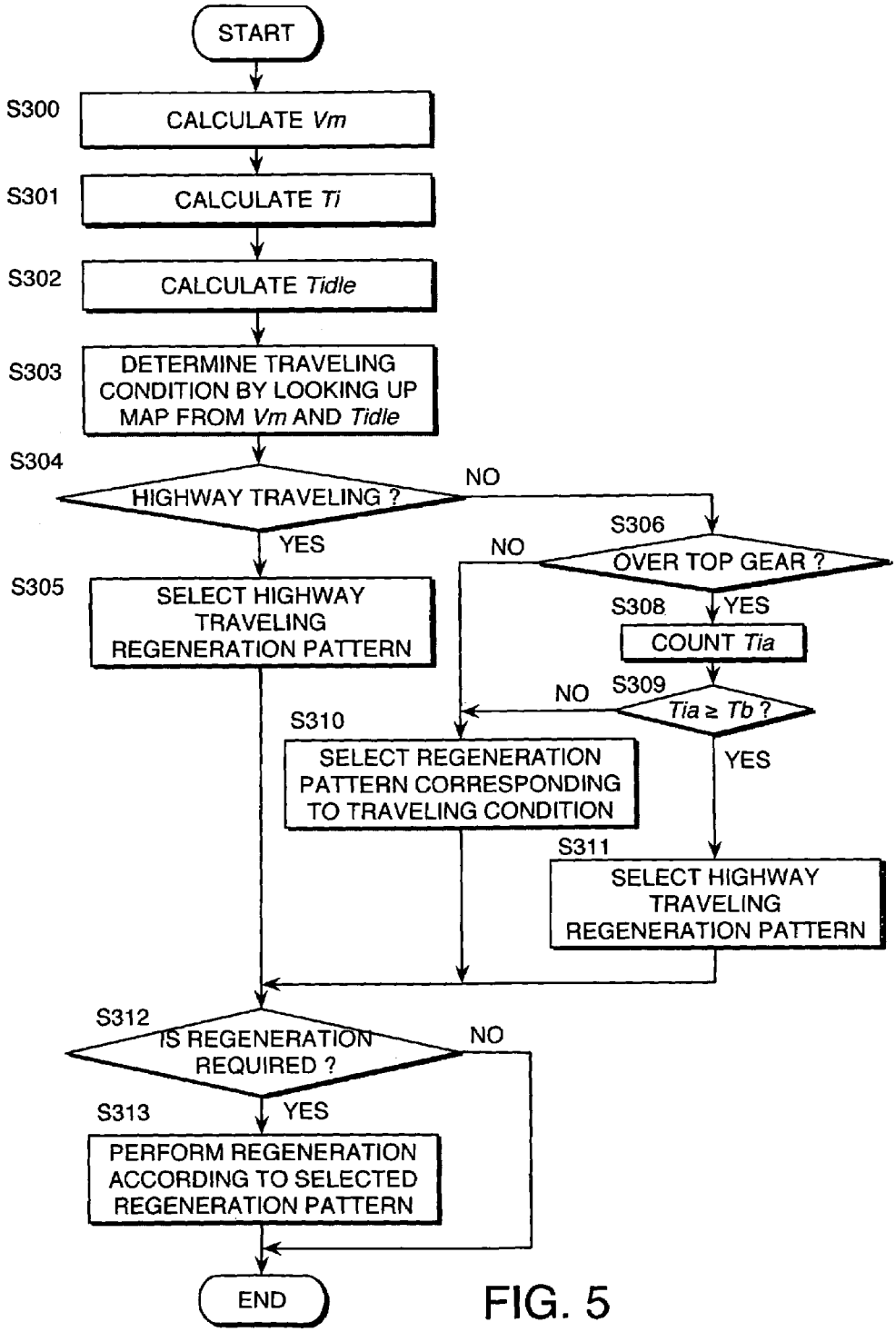
FIG. 5 is similar to FIG. 2, but shows a third embodiment of this invention.

Next, referring to FIG. 5, a third embodiment of this invention will be described.

This embodiment is applied to a vehicle comprising an over top gear. All other hardware constitutions are identical to those of the first embodiment. In this embodiment, a routine illustrated in FIG. 5 is executed in place of the routine of the first embodiment in FIG. 2.

The processing content of steps S300–S305 is identical to that of the steps S100–S105 of the first embodiment.

When it is determined in the step S304 that the traveling condition does not correspond to the highway traveling condition, the engine controller 16 determines in a step S306 whether or not the currently applied gear is the over top gear on the basis of an input signal from the gear position sensor 26. When the over top gear is in use, the engine controller 16 determines that the vehicle is traveling at high speed.

When the currently applied gear is not the over top gear, the engine controller 16 selects a regeneration pattern corresponding to the traveling condition in a step S310. The traveling condition is the traveling condition determined in the step S303.

When the currently applied gear is the over top gear, the engine controller 16 measures a continuous over top gear application period Tia in a step S308. This measurement is performed by the timer 27. Alternatively, the timer value may be counted up every time the routine is executed.

Next, in a step S309, the engine controller 16 determines whether or not the continuous period Tia has reached a continuous high-speed traveling target time Tc. Herein, the continuous high-speed traveling target time Tc is set to two minutes. If the continuous period Tia has not reached the continuous high-speed traveling target time Tc, the engine controller 16 selects a regeneration pattern corresponding to the traveling condition in the step S310. Following the processing of the step S310, the engine controller 16 performs the processing of the step S312.

The processing of the step S312 and a step S313 is identical to the processing of the steps S107 and S108 in the first embodiment.

In this embodiment, the highway traveling regeneration pattern is executed when the over top gear is used continuously for the continuous high speed traveling target time Tc, even when the traveling condition during the predetermined time period up to the present time does not correspond to the highway traveling condition. As a result, similarly to the second embodiment, opportunities for executing complete regeneration of the DPF 10 can be increased.

In this embodiment, use of the over top gear is set as the condition for applying the highway traveling regeneration pattern. Hence the over top gear is the gear which corresponds to the target high speed Va used in the second embodiment. Depending on the gear setting in the transmission of the vehicle, however, the gear corresponding to the target high speed Va may be a gear other than the over top gear. In this case, a continuous use period of the gear which corresponds to the target high speed Va is set as the condition for applying the highway traveling regeneration pattern.

Figure 6:
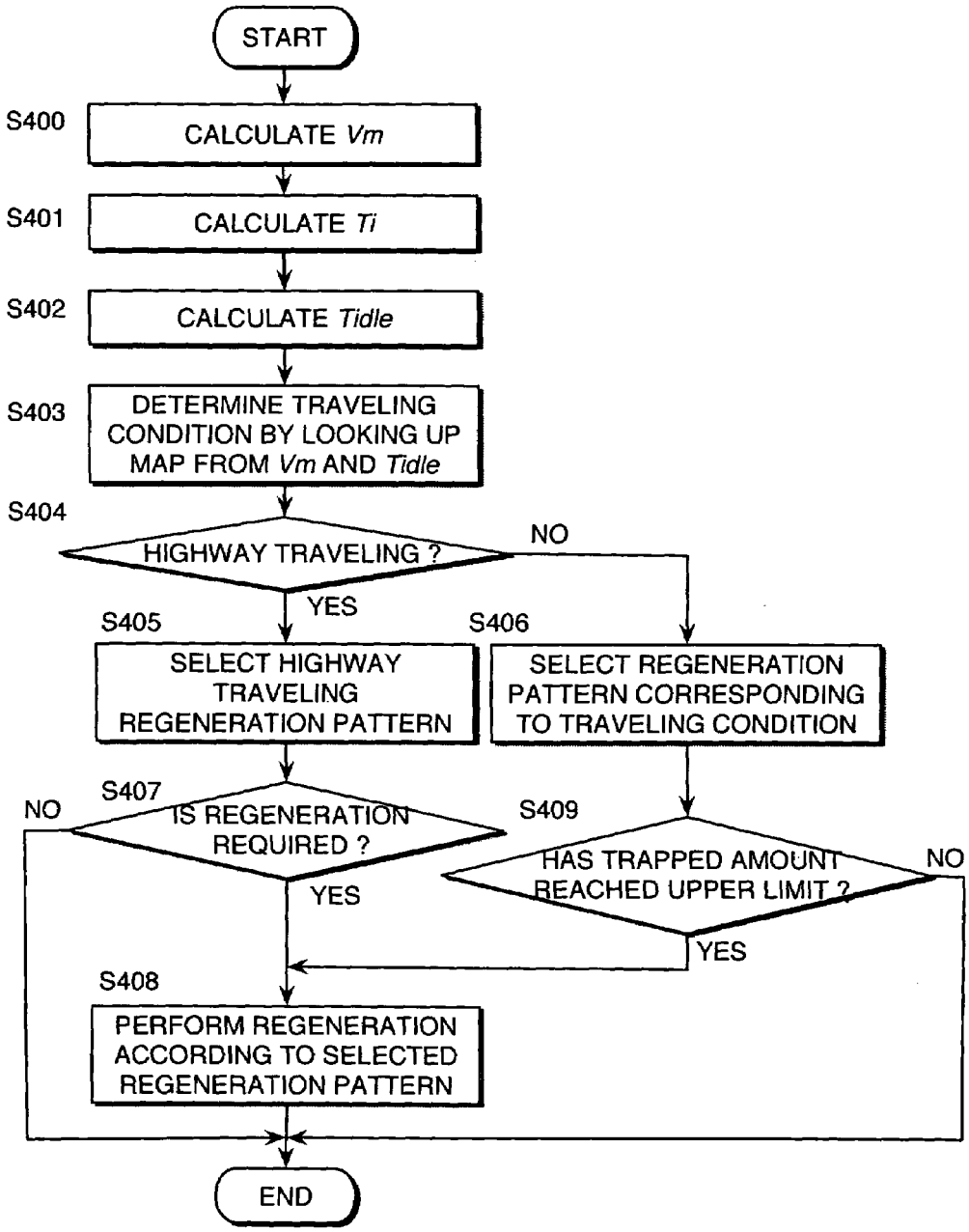
FIG. 6 is similar to FIG. 2, but shows a fourth embodiment of this invention.

Next, referring to FIG. 6, a fourth embodiment of this invention will be described.

The hardware constitution of this embodiment is identical to that of the first embodiment, but the method of determining whether or not to perform regeneration differs from the first embodiment. In this embodiment, a routine illustrated in FIG. 6 is executed in place of the routine of the first embodiment in FIG. 2.

The processing of steps S400–S408 is identical to that of the steps S100–S108 in the first embodiment.

In this embodiment, the determination of a step S409 follows the step S406.

More specifically, having selected a regeneration pattern other than the highway traveling regeneration pattern in the step S406, the engine controller 16 determines in the step S409 whether or not the amount of particulate matter trapped in the DPF 10 has reached its upper limit.

If the amount of particulate matter trapped in the DPF 10 has not reached the upper limit, the engine controller 16 ends the routine without regenerating the DPF 10. If the amount of particulate matter trapped in the DPF 10 has reached the upper limit, the engine controller 16 performs regeneration of the DPF 10 in the step S408 on the basis of the regeneration pattern selected in the step S406.

When the highway traveling regeneration pattern is selected in the step S405, then the determination performed in the step S407 as to whether or not the DPF 10 needs to be regenerated depends on whether the amount of particulate matter trapped in the DPF 10 has reached a regeneration permitting amount that is specifically set for highway traveling. The regeneration permitting amount used this step is set at 50% of the upper limit. This value is smaller than the regeneration permitting amount set in the step S107, S212 and S312, because the processing of the step S407 is performed only during highway traveling. As explained above, highway traveling is most suitable among other running conditions for the regeneration of the DPF 10, so the regeneration permitting amount is set to a smaller value in order to increase the occasions of DPF regeneration during highway traveling. This embodiment also differs from the first embodiment in that when a regeneration pattern other than the highway traveling regeneration pattern is selected, regeneration is not performed until the amount of particulate matter trapped in the DPF 10 reaches the upper limit.

If the traveling condition changes to the highway traveling condition while waiting for the amount of trapped particulate matter to reach the upper limit before performing regeneration, complete regeneration of the DPF 10 is performed on the basis of the highway traveling regeneration pattern. In this embodiment, opportunities for performing regeneration in the highway traveling regeneration pattern can be increased.

Similar effects can be obtained in the second and third embodiments by determining the condition for executing regeneration in a regeneration pattern other than the highway traveling regeneration pattern in a similar manner to this embodiment.

The contents of Tokugan 2003-325028, with a filing date of Sep. 17, 2003 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

The embodiments of this invention in which an exclusive property or privilege is claimed are defined as follows:

What is claimed is:

1. A regeneration device for a filter which traps particulate matter contained in an exhaust gas of a diesel engine for a vehicle, comprising:

a parameter detecting sensor which detects a parameter relating to an amount of particulate matter trapped in the filter;

a removal mechanism which removes the particulate matter trapped by the filter;

a sensor which detects a rotation speed of the diesel engine; and a programmable controller programmed to:

determine whether or not the amount of particulate matter trapped in the filter has reached a predetermined amount;

calculate an idling frequency which is defined as the proportion of time when the diesel engine runs idle during a latest predetermined time period;

determine a traveling condition of the vehicle based on the idling frequency, wherein the latest predetermined period of time is of sufficient duration to permit calculation of the idling frequency upon which the traveling condition determination can be made; and control the removal mechanism, when the amount of trapped particulate matter has reached the predetermined amount, to remove the particulate matter by applying a predetermined removal pattern which is different for each traveling condition of the vehicle.

2. The regeneration device as defined in claim 1, wherein the traveling condition of the vehicle comprises a highway traveling condition, and the controller is further programmed to control the removal mechanism to apply a pattern for removing all of the trapped particulate matter when the particulate matter trapped by the filter is to be removed in the highway traveling condition.

3. The regeneration device as defined in claim 2, wherein the regeneration device further comprises a sensor which detects a vehicle speed, and the controller is further programmed to calculate an average vehicle speed and to determine a traveling condition based on the average vehicle speed and the idling frequency during the latest predetermined time period.

4. The regeneration device as defined in claim 3, wherein the controller is further programmed to control the removal mechanism to apply the pattern for removing all of the particulate matter trapped by the filter when the vehicle speed is not lower than a predetermined value continuously for a predetermined target time period, even when the traveling condition does not correspond to the highway traveling condition.

5. The regeneration device as defined in claim 3, wherein the vehicle comprises a transmission having a plurality of gears, the regeneration device further comprises a sensor which detects a gear position of the transmission, and the controller is further programmed to control the removal mechanism to apply the pattern for removing all of the particulate matter trapped by the filter when a predetermined gear is used continuously for a predetermined target time period, even when the traveling condition does not correspond to the highway traveling condition.

6. The regeneration device as defined in claim 1, wherein the predetermined amount is set at 80–90% of an upper limit of the amount of particulate matter trapped in the filter.

7. The regeneration device as defined in claim 6, wherein the traveling condition of the vehicle comprises a highway traveling condition, and the controller is further programmed to control the removal mechanism to remove the particulate matter trapped in the filter by applying the pattern for removing all of the trapped particulate matter when the trapped amount reaches the predetermined amount in the highway traveling condition while preventing the removal mechanism from removing the particulate matter until the trapped amount has reached the upper limit in a traveling condition other than the highway traveling condition.

8. A regeneration device for a filter which traps particulate matter contained in an exhaust gas of a diesel engine for a vehicle, comprising:

means for detecting a parameter relating to an amount of particulate matter trapped in the filter;

means for removing the particulate matter trapped by the filter;

means for detecting a rotation speed of the diesel engine;

means for determining whether or not the amount of particulate matter trapped in the filter has reached a predetermined amount;

means for calculating an idling frequency which is defined as the proportion of time when the diesel engine runs idle during a latest predetermined time period;

means for determining a traveling condition of the vehicle based on the idling frequency, wherein the latest predetermined period of time is of sufficient duration to permit calculation of the idling frequency upon which the traveling condition determination can be made; and means for controlling the removal mechanism, when the amount of trapped particulate matter has reached the predetermined amount, to remove the particulate matter by applying a different pattern according to the traveling condition of the vehicle.

9. A regeneration method for a filter which traps particulate matter contained in an exhaust gas of a diesel engine for a vehicle, the vehicle comprising means for removing the particulate matter trapped by the filter; the method comprising:

determining a parameter relating to an amount of particulate matter trapped in the filter;

determining a rotation speed of the diesel engine;

determining whether or not the amount of particulate matter trapped in the filter has reached a predetermined amount;

calculating an idling frequency which is defined as the proportion of time when the diesel engine runs idle during a latest predetermined time period;

determining a traveling condition of the vehicle based on the idling frequency, wherein the latest predetermined period of time is of sufficient duration to permit calculation of the idling frequency upon which the traveling condition determination can be made; and controlling the removal mechanism, when the amount of trapped particulate matter has reached the predetermined amount, to remove the particulate matter by applying a different pattern according to the traveling condition of the vehicle.

* * * * *